US006159399A

United States Patent [19]

Schmid

[11] Patent Number: 6,159,399

[45] Date of Patent: Dec. 12, 2000

[54] PROCEDURE FOR THE ERECTION OF CONCRETE WALLS USING BRACED BOARDINGS AND DEVICE TO CARRY OUT THE SAME

[75] Inventor: Rene P. Schmid, Oberweningen, Switzerland

[73] Assignee: Rascor Spezialbau GmbH, Germany

[21] Appl. No.: 09/199,022

[22] Filed: Nov. 24, 1998

Related U.S. Application Data

[62] Continuation of application No. 08/769,883, Dec. 19, 1996, Pat. No. 5,914,137, which is a continuation of application No. 08/331,651, filed as application No. PCT/EP93/01199, May 13, 1993, abandoned.

[30] Foreign Application Priority Data

May 13, 1992 [DE] Germany ..... 42 15 731

[51] Int. Cl.[7] ..... E04B 1/16

[52] U.S. Cl. ..... 264/35; 249/38; 249/40; 249/83; 425/129.1

[58] Field of Search ..... 249/39, 83, 38, 249/97, 40; 264/35; 425/129.1

[56] References Cited

U.S. PATENT DOCUMENTS

| | | | |
|---|---|---|---|
| 4,499,925 | 2/1985 | Kaufmann | 138/125 |
| 4,722,479 | 2/1988 | Koob | 239/145 |
| 5,056,282 | 10/1991 | Pflieger | 52/173 R |
| 5,257,486 | 11/1993 | Holmwall | 52/514.5 |
| 5,328,647 | 7/1994 | Koob | 264/34 |
| 5,914,137 | 6/1999 | Schmid | 425/129.1 |

FOREIGN PATENT DOCUMENTS

| | | |
|---|---|---|
| 0 418 699 A1 | 3/1991 | European Pat. Off. . |
| 2 532 675 | 3/1984 | France . |
| 89 04 243 | 11/1989 | Germany . |
| 42 15 731 A1 | 11/1993 | Germany . |
| 600 077 | 6/1978 | Switzerland . |
| WO 93/01199 | 1/1993 | WIPO . |

OTHER PUBLICATIONS

*Infiltra–stop: For Waterproofing Construction Joints*, Industrie Park, 8, B–3100 heist O/D Berg, Belgium.

*Primary Examiner*—Karen Aftergut
*Attorney, Agent, or Firm*—Jones & Askew, LLP

[57] ABSTRACT

A spreader pipe for use in erecting concrete walls. The spreader pipe may contain at least one hole in its wall which is then covered with an impermeable cuff to prevent the poured concrete from passing into the spreader pipe. Once the wall has been erected and the boarding plates removed, grout may be injected into the spreader pipe in such a manner that it flows through the at least one hole and passes from the cuff into the hollow spaces and cracks in the concrete wall around the spreader pipe thereby making the concrete wall substantially waterproof. Alternatively, the spreader pipe may contain weak spots, rather than the at least one hole, which are punctured by the pressure of the grout being forced into the spreader pipe, thereby filling the hollow spaces and cracks in the concrete wall around the spreader pipe.

37 Claims, 4 Drawing Sheets

Figure 1:
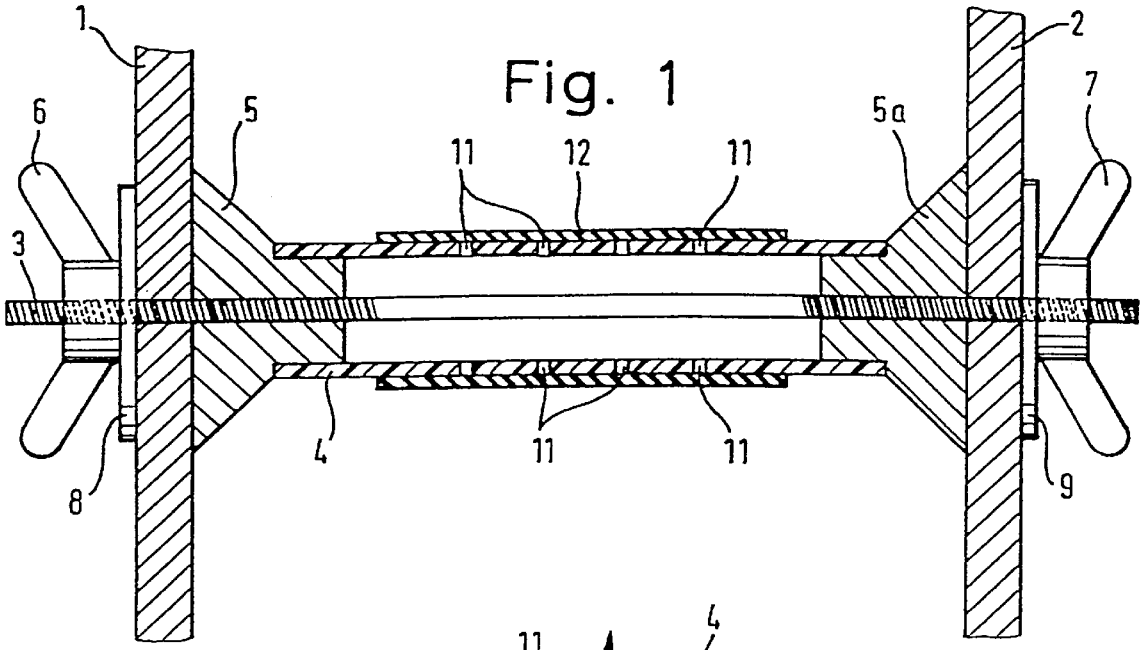

PROCEDURE FOR THE ERECTION OF CONCRETE WALLS USING BRACED BOARDINGS AND DEVICE TO CARRY OUT THE SAME

This application is a continuation of U.S. application Ser. No. 08/769,883, filed Dec. 19, 1996, now U.S. Pat. No. 5,914,137, which is a continuation of U.S. application Ser. No. 08/331,651, filed Feb. 13, 1995, now abandoned, which is a national phase application under 35 U.S.C. § 371 of International Application PCT/EP93/01199 filed May 13, 1993.

The invention refers to a procedure to erect concrete walls using braced boardings. The invention also refers to a device to carry out said procedure.

The above mentioned procedure serves for the erection of concrete walls. The boarding plates are mounted parallel to each other at a distance from each other equal to the thickness of the concrete wall to be erected. Turnbuckles are used to lock in position and brace the boarding plates, whereby so called spreader pipes having sufficient stiffness to brace the boarding plates apart are used as boarding spacers and opposite anchoring elements, which are penetrated by the turnbuckles and rest on cone-shaped depressions located on the inner sides of the boarding plates. The boarding plates are braced with screw elements such as large butterfly screws which can be screwed into the turnbuckles on the outside of the boarding. Concrete is then poured on site into the boarding prepared in this fashion.

After the concrete has set, the boarding plates are removed by first unscrewing the screw elements on the turnbuckle ends and then pulling the turnbuckles out of the pipes and or spreader pipes.

After removing the boarding from the concrete walls, the cone-shaped depressions are removed from the pipe ends, while the spreader pipes remain as discarded pipes inside the concrete walls which consequently due to the remaining spreader pipes are permanently perforated in several parts. These wall passages are filled with grout, for instance with special expanding filling mortar. Usually, the filling is carried out by closing the spreader pipe on one end with a cap while the grout is poured into the other end of the pipe with a fill injector. The cap has a hole to allow the expulsion of air displaced during the filling process. After the wall passages have been filled, the concrete wall is finished, whereby it can be assumed that the concrete wall is not only watertight in the undisturbed area but also in the area containing the spreader pipes.

The inventor realized that when the hollow spaces between the boarding plates are filled with liquid concrete and after the concrete has set, hollow spaces and/or cracks form in the area adjacent to the spreader pipe jacket, which can spread up to the exterior surfaces of the erected concrete wall or which will expand with time to the exterior surfaces, thus not allowing to ensure the watertightness of the erected concrete walls.

The purpose of the present invention is to create a procedure for the erection of concrete walls by means of boardings of the above mentioned type which allows to make the stretching areas watertight. In addition, a simple and safe device to carry out the procedure had to be created.

With the procedure according to the invention, the hollow spaces or cracks between the pipe jacket and the concrete wall material are filled while the spreader pipes are filled, so that the stretching areas in the concrete wall are also made completely watertight. With the conventional method only the pipe itself was sealed. The permanently in the exterior area of the pipe jacket had not been recognized. But by filling the interior of one pipe it was not possible to seal the cracks and hollow spaces of adjacent discarded pipes in the concrete wall. The invention allows to seal these unprotected areas in concrete walls.

The preferred means to carry out the procedure according to the invention is a spreader pipe or an expansion pipe provided with passages in the jacket which are covered, for instance, with a cuff mounted outside on the pipe and made, for instance, of a flexible and pliable material. With the cuff, the pipe according to the invention can be used together with the turnbuckle like a conventional spreader pipe, since liquid concrete poured between the boarding plates cannot penetrate into the holes or openings in the pipe jacket because of the cuff. Preferably, the openings are located at least in the longitudinal central area of the pipe jacket.

For the purpose of the invention, it is irrelevant whether the pipes are open throughout their length or have inside walls.

The cuff sealing or covering the pipe openings may be made of a material which is resistant to liquid concrete until the latter has set. Consequently, a suitable material for the cuff is among others paper or cardboard, whereby these should preferably be impregnated with a moisture resistant or water permeable coating. A cuff made of rubber or an elastic plastic which ensures the desired sealing or covering functions is also suitable.

A preferred device to carry out the procedure according to the invention using, for instance, the perforated pipe as a spreader pipe with the mounted cuff, consists of a packer-like injecting device inserted in the spreader pipe which has an injection pipe whose jacket is provided with injection openings or injection nozzles. The injection pipe is sealed on both sides. The radial sealing and bracing of the packer on both sides in order to create a sealed off injection area in the spreader pipe is accomplished, for instance, by using a rubber cuff on the injection pipe.

The grout is fed into the packer from a container under pressure through a pipeline, in principle using the same material used for the subsequent filling of the pipe interiors. Expanding filling mortar is generally a mixture of Portland cement, finely graded quartz sand and reactive chemical additives which bring about the desired expanding effect.

According to a special embodiment of the invention, the procedure according to the invention as well as the spreader pipe according to the invention are used to inject a sealing medium into a sealing device in order to seal the joint formed between two sections made of concrete. A sealing device of this type, for instance, is described in EP-A1-0 418 699. This device consists of a body which forms an injection path for a sealing medium in the joint area on the concrete surface of one of the sections made of concrete, from which, after the second section made of concrete has been mounted, the sealing medium injected into the bodies can leak out into defective areas in the concrete located in the joint areas between the two pieces of concrete. The bodies are canal-shaped structures, as described in EP-A1-0 418 699, or porous hoses according to CH-PS 600 077 which according to DE-GM 83 35 231 can have supporting bodies in the shape of spiral springs or which according to DE-GM 86 08 396 can be a sealing device in the shape of injection hoses which on one hand solves the disadvantage of having to position the hose through straps provided on the hose, and on the other hand have a preset breaking point in longitudinal direction on the hose-shaped body through which the sealing medium flows into the concrete. Usually the sealing medium is pressed directly into the opening of the hose or the end of the hose. The opening and the end of the hose must be readily accessible from outside after the concreting work in the joint area is completed. In this case the concrete boarding must have recesses for the hose ends, the mounting of which makes the boarding operation more difficult. In this context, EP-A1-0 418 699 suggests to perforate the canal described in said publication after the second section made of concrete has set and the boarding has been removed, and to press the sealing medium through this hole into the interior of the sealing device. According to another suggestion, the places on the canal where the perforations are to be made should be provided with a larger hollow sighting body in order to facilitate the perforating operation and the targeting of the canal. According to the present invention, the procedure for the filling of such sealing devices with sealing material is simplified by using the spreader pipes already placed in the concrete wall. Therefore, it is not necessary to drill a hole into the concrete from outside or to create special installations in order to carry the end or the opening of an injection hose or an injection canal to the outside.

Figure 2:
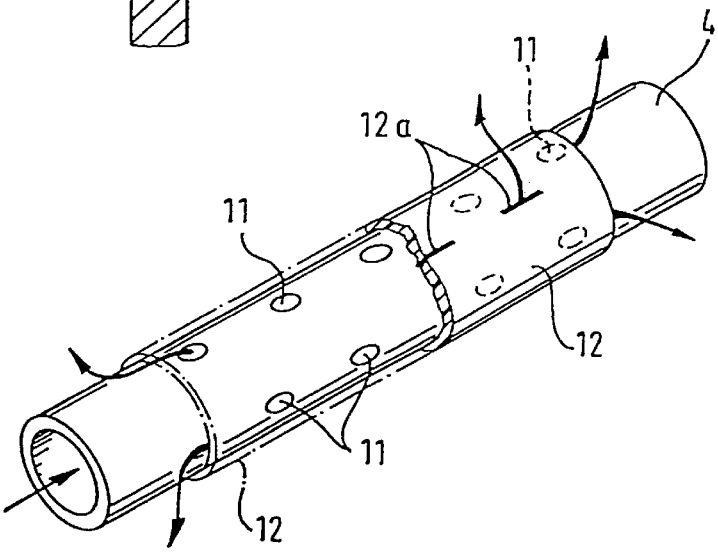
Figure 4:
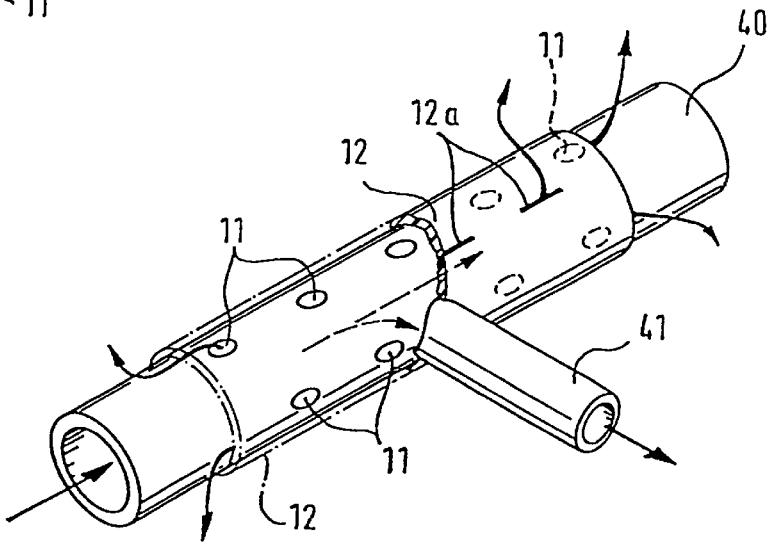
Figure 3:
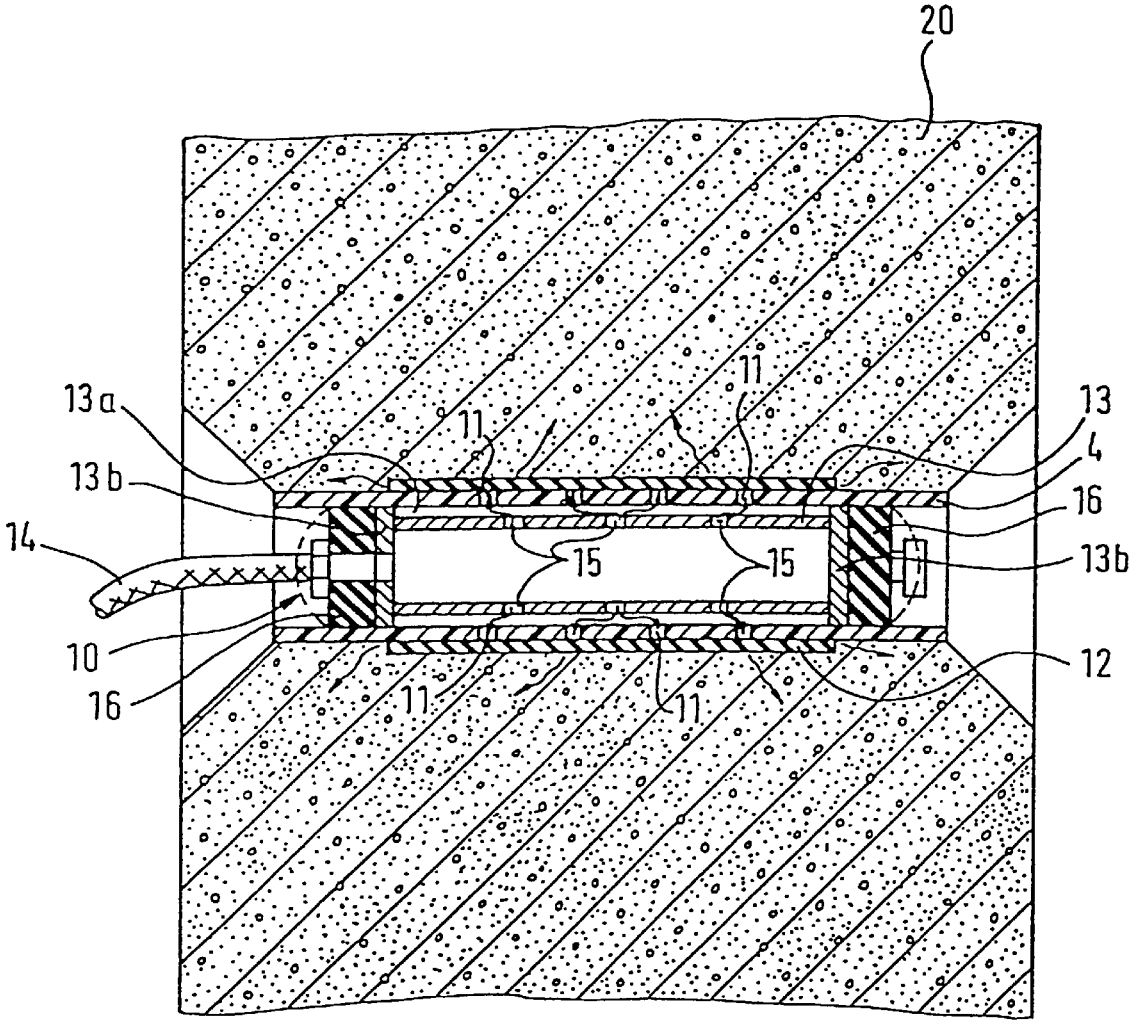
Figure 5:
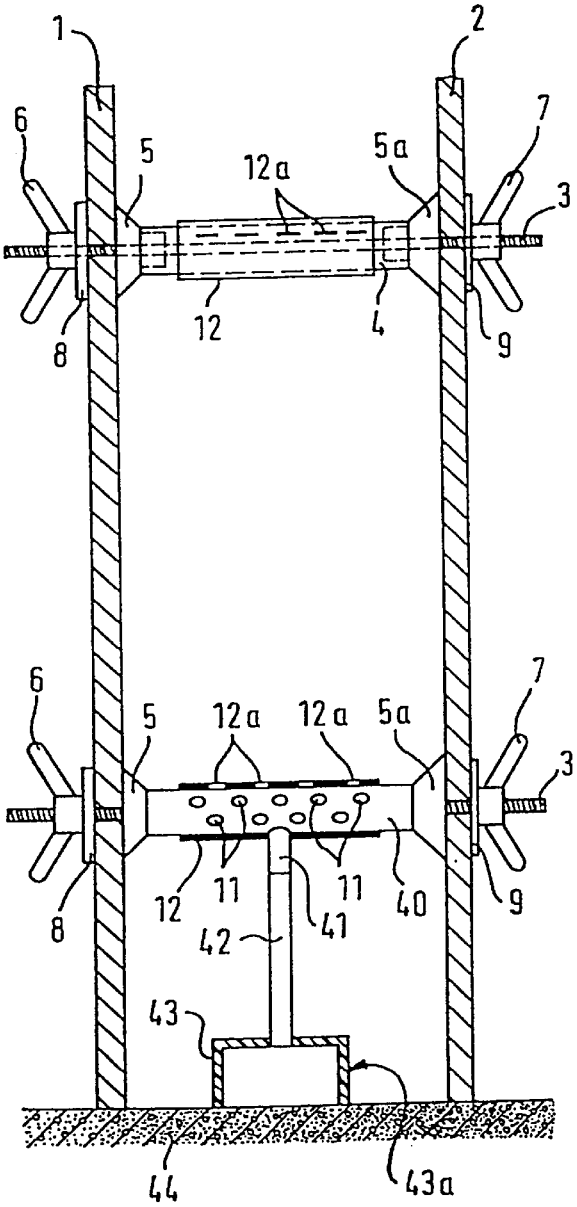
Figure 6:
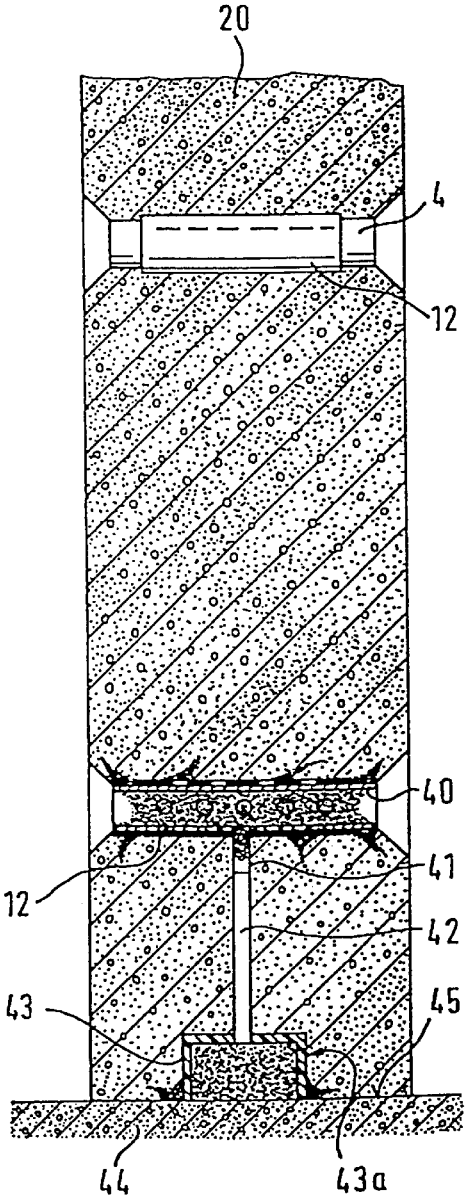
Figure 7:
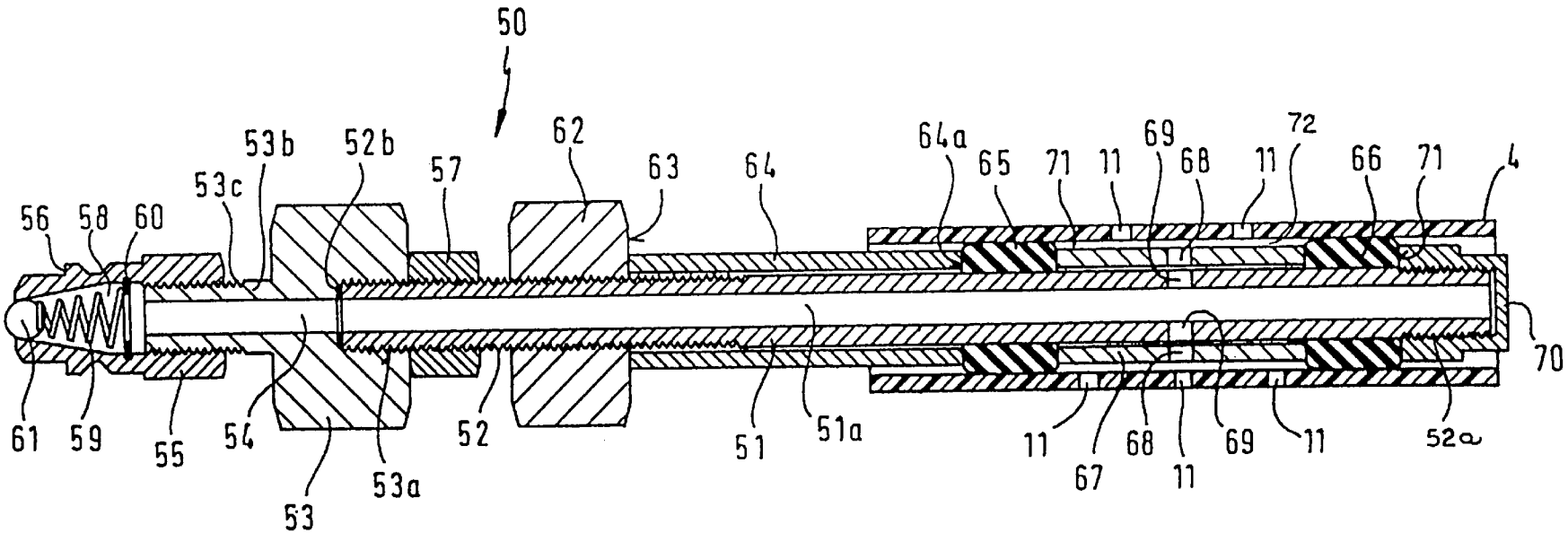

The invention will be explained in more detail with the help of the drawings. The following are shown:

FIG. 1 A cross section through a boarding structure for the erection of a concrete wall using a preferred embodiment of the spreader pipe according to the invention;

FIG. 2 A perspective representation of the spreader pipe in FIG. 1;

FIG. 3 A cross section through a concrete wall in the stretching area after the boarding has been removed, with a packer located in the spreader pipe intended to feed the grout;

FIG. 4 a perspective representation of an improved embodiment of the spreader pipe according to the invention;

FIG. 5 a cross section through a boarding structure for the erection of a concrete wall using the spreader pipe shown in FIG. 4 which is connected to an injection system;

FIG. 6 a cross section through a concrete wall erected with the boarding structure according to FIG. 5, after removal of the boarding;

FIG. 7 a preferred embodiment of the injection packer for the feeding of grout into the spreader pipe according to the invention.

FIG. 1 shows a section of the boarding for the erection of a concrete wall before it is filled with liquid concrete. The boarding has two boarding plates 1 and 2 provided with anchors and kept at equal distance from each other. Each anchor has a turnbuckle 3, e.g. in the form of steel bars provided on each end with a thread. An expansion pipe or spreader pipe 4 is placed between the boarding plates 1 and 2 which has conical depressions 5 and 5*a* located in the openings of the spreader pipe 4 adjacent to the interior surfaces of the boarding plates 1 and 2. The depressions 5, 5*a* which rest with their entire front surface on the interior surfaces of the boarding plates 1 and 2, extend with their other ends into the spreader pipe 4 and have passage holes which are penetrated by the turnbuckle 3 which also penetrates the spreader pipe 4 and one hole in each boarding plate 1, 2. The anchors are braced with butterfly screws 6 and 7 which are screwed onto the threads provided on the ends of the turnbuckles 3, and act on the boarding plates 1 and 2 through large surface supporting disks 8 and 9.

The boarding braced in this fashion is generally filled with liquid concrete. After the concrete has set, the boarding plates 1 and 2 are removed, after the turnbuckle 3 together with the tightening screws 6,7 and the support disks 8, 9 have been removed. Then the depressions 5 and 5*a* are pulled out of the concrete wall 20; the pipes 4 remain as discarded parts inside the concrete wall 20. The area of the discarded spreader pipe 4 in a finished, erected concrete wall 20 is shown in FIG. 3.

The pipe walls of the expansion pipe or the spreader pipe 4 has several passages, in particular in its longitudinal central area, for instance, in the form of holes 11. The holes 11 are covered by a cuff 12 pulled over the longitudinal central area of the expansion pipe 4, the cuff having a length which ensures that all passages 11 are covered. By using the cuff 12, the spreader pipe can be mounted and used in the conventional fashion, because the cuff safely prevents liquid concrete from penetrating into the passages 11.

After the boarding is removed and the discarded pipe 4 is exposed, a packer-like injecting device 10 is inserted into the pipe 4. The injecting device has a pipe 13, the jacket of which is provided with openings, for instance, in the form of holes 15 and whose outside diameter is smaller than the inside diameter of the discarded pipe 4 so that an annular cylindrical space 13*a* is formed between the packer pipe 13 and the discarded pipe 4. The packer 10 with its pipe 13 is inserted into the cuff area of the spreader pipe 4. The packer pipe 13 is closed on the front side by circular disks 13*b*, whose diameter is equal to the inside diameter of the discarded pipe 4. The outside of the disks 13*b* is provided, for instance, with cylindrical sealing plugs 16 made of a flexible material. One of the sealing plugs 16 has a central passage which is in alignment with a passage in the adjacent disk 13*b*, and a hose 14 which is connected to the passage of the sealing plug 16. The two sealing plugs 16 can be extended in radial direction in order to be braced against the inside wall of the pipe 4. For this purpose the sealing plugs 16 are shaped, for instance, like a balloon, and can be supplied through a hose pipe (not shown) with compressed air, so that the sealing balloon is braced in radial direction against the inside wall of the pipe. Alternatively, the two sealing plugs 16 can be cylindrical sealing disks used with an axially acting compression device, so that the sealing disk material compressed in axial direction gives way in radial direction and is braced against the inside walls of the pipe 4. In either case, the compressed sealing plugs 16 allow to seal the end of the spreader pipe 4.

Grout is fed under pressure into the pipe 13 through a hose pipe 14. Grout runs through these holes 15 reaching the holes 11 of the spreader pipe 4 and through the holes 11, as shown with arrows in FIG. 3, underneath and from the cuff 12 into the cracks and hollow spaces of the concrete wall 20 which remain between the jacket of the pipe 4 and the concrete after the liquid concrete has been poured and has set, thus safely sealing this critical area.

Following this step of the procedure, the packer 10 is pulled out of the pipe 4, after releasing the sealing pipe 16, and the inside of the pipe is filled in the usual manner, for instance, with grout using a known injection packer, thus completely sealing the concrete wall in the area of the spreader pipe 4.

It is advantageous if the cuff 12 has at least one vent slit 12*a*, preferably several vent slits 12*a*, which are preferably not located over a hole 11 (FIG. 2). Preferably, several slits 12*a* should be arranged in a row along an axis-parallel line of the cuff jacket 12, extending in longitudinal direction. If—as illustrated—several holes 11 are arranged in a row, for instance, along a longitudinal line of the pipe jacket 4, then the slits 12*a* should be arranged on another staggered longitudinal line in the cuff jacket 12, whereby in addition the slits 12*a* should preferably not be located on the same peripheral line as the openings 11 but should preferably be located exactly between two neighbouring peripheral lines of the holes 11, and the slits 12*a* should also be distributed on a peripheral line.

FIG. 4 shows a modified embodiment of the spreader pipe 4 shown in FIG. 2. The use of this spreader pipe 40 according to the invention is illustrated in FIGS. 5 and 6.

Contrary to the spreader pipe 4, the pipe 40 has a radially projecting socket 41 with a smaller diameter than the pipe 40 which penetrates the cuff 12 and is firmly connected to the pipe, opening out into the same.

FIG. 5 shows a cross-section of a boarding for the erection of a concrete wall, whereby the upper part of the shown boarding corresponds to the one illustrated in FIG. 1 and has two boarding plates 1 and 2, a spreader pipe 4 placed between the boarding plates 1 and 2 which is supported by the depressions 5 and 5*a* on the inside of the boarding plates 1 and 2, and is penetrated by a turnbuckle 3 on whose ends are screwed on butterfly screws 6 and 7 which acts through supporting disks 8 and 9 on the outside of the boarding plates 1 and 2.

As an additional spacer for the two boarding plates 1 and 2, the spreader pipe 40 with sockets 41 illustrated in FIG. 4 is mounted in a specific place, the pipe 40 being supported in the same fashion on depressions 5 and 5*a* on the inside of the boarding plates 1 and 2. Turnbuckles 3, butterfly screws 6,7, and supporting disks 8 and 9 are used as chucking elements, like in the anchoring arrangement with the spreader pipe 4. The pipe sockets 41 projecting downwards from the pipe 42 have a hose which is connected to the injection canal 43 of a sealing device 43*a* known from EP-A1-0 418 699, said canal having a U-shaped cross-section extending parallel to the boarding plates 1 and 2, for instance, along their entire length, and resting with its side walls on a concrete plate 44. Instead of the canal, other known injection devices can be connected in the same fashion to the pipe socket 41.

FIG. 6 shows the concrete wall 20 built by filling concrete into the boarding shown in FIG. 5, letting it set and removing the boarding plates 1 and 2 after first removing the turnbuckles 3 together with the tightening screws 6, 7, and the supporting disks 8 and 9 as well as the depressions 5 and 5*a*. The upper pipe 4, the lower pipe 40, the connecting hose 42 and the injection canal 43 remain in the concrete wall 20 as discarded parts. Before filling with concrete the passages created in the concrete wall 20 by the pipe 4, 40, a sealing material is introduced in the above described fashion through the slits or openings in the pipes 4 and 40 into the hollow spaces and cracks outside the pipe 4 and 40, using the procedure according to the invention, for instance, with the above described injection packer. So far, the measures to seal the stretching points with grout correspond to the ones described above by means of FIGS. 1 to 3. In addition, thanks to the transmission connection between the pipe 40 and the injection canal 43 through the pipe socket 41 and the connecting hose 42, defective parts in the concrete, in the joint area 45 between the underside of the wall 20 and the surface of the concrete plate 44, are sealed because sealing material or grout introduced into the pipe 40 in the above described fashion not only flows out through the openings 11 and 12*a* in the pipe 40 into the hollow spaces or cracks in the concrete wall 20 adjacent to the pipe 40, but the sealing material also reaches the injection canal 43 through the pipe sockets 41 and the contacting hose 42, completely filling the canal with the filling or sealing material under pressure which can flow out from the free longitudinal edges of the canal 43 and into the joint area 45 as well as into the cracks and hollow spaces between the concrete wall 20 and the outside area of the injection canal 43. The essential point is that through the connection of the sealing devices according to the invention, i.e. the pipe 40 and the injection canal 43, different uptight areas in a concrete wall 20 on a concrete plate 44 can be sealed at the same time in one procedure, i.e. by introducing grout into the two hollow bodies.

FIG. 7 shows another embodiment of the packer 50 for the use in spreader pipes according to the invention. FIG. 7 shows the spreader pipe 4 in a concrete wall 20 (not shown) with the packer 50 pushed into its front part.

The packer has a jet tube 51 extending approximately two thirds of the packer 50 and sections with external threads 52 and 52*a* on its ends, the threaded section 52 on the jet side extending approximately over one third of the jet tube 51. A nozzle tip screw 53 has a through-hole 54 with the same diameter as the inside diameter of the pipe 51. A blind hole 53*a*, coaxial to the throughhole 54 in the nozzle tip screw 53 has an internal thread with which the screw 53 is screwed onto the end of the threaded section 52. Between the ring-shaped bottom of the blind hole 53*a* and the ring-shaped face of the threaded section 53 is a sealing washer 52*b*. The position of the screw 53 on the threshold section 52 is secured with a lock nut 57 which rests with its internal thread on the threaded section 52 of the jet tube, acting with one of its front surfaces on the adjacent front surface of the nozzle tip screw 53.

The nozzle tip screw 53 also has a cylindrical socket 53*b* formed in one piece which has a smaller diameter and is provided with an external thread 53*c*. A valve coupler 55 is screwed onto the thread 53*c* by means of an internal thread which on its external free end has a profile border 56 for the connection with a hose coupler (not shown). The tight fitting of the coupler 55 on the thread 53*c* is ensured by means of a teflon strip placed between the engaging threads. A conical spiral spring 59 is placed in the interior 58 of the coupler 55 coaxially to the longitudinal centre of the jet tube 51. The spring 59 rests with its end with the larger diameter on a ring disk 60 placed in a ring groove in the inside wall of the coupler 55; the end with the smaller diameter of the spring 59 acts with initial tension on a ball 61 which functions as a valve, closing the entrance to the coupler 55 under the initial tension of the spring.

In addition, on the thread 52 is a cylindrical tightening nut 62 whose front surface 63 rests on the annular front surface of a jacket encasing tube 64. A first draw-in hose 65 made of a flexible material such as plastic, mounted on the outer jacket surface of the jet tube 51 borders on the other ring-shaped front surface 64*a* of the jacket encasing tube 64. A second similar draw-in hose 66 is also mounted on the jet tube 51 in front of the thread 52*a* at an axial distance from the first draw-in hose 65. Between the two hoses 65 and 66 on the jet tube 51 is an additional jacket encasing tube section 67 which sets the distance between the two hoses 65 and 66 and has holes 68 in its jacket which preferably should be in alignment with holes 69 in the jet tube 51.

A cylindrical cap 70 is screwed onto the thread 52*a* of the jet tube 51 which with its ring-shaped front edge 71 abuts against the ring-shaped front edge of the second draw-in hose 66 adjacent to that edge, and closes the passage 51*a* of the jet tube 51.

The injection packer 50 is similar to known injection packers for the filling of spreader pipes, except for the jacket encasing tube 67, the second draw-in hose 66 and the cap 70. The packer with its draw-in hoses 65 and 66 located at an axial distance from each other is placed in the spreader pipe 4 in such fashion that the holes 11 of the spreader pipe 4 are located in the area between the two draw-in hoses 65 and 66.

The external diameter of the jacket encasing tube section 67 is smaller than the internal diameter of the spreader pipe 4, so that a ring-cylindrical space 72 is formed which is sealed off by the draw-in hoses 65 and 66. The draw-in hoses 65 and 66 are compressed in axial direction by shifting the tightening nut, bulging out in axial direction and being pressed against the inside wall of the spreader pipe 4. During this turning movement of the tightening nut 62, the cap 70 forms an outer support for the movement of the jacket encasing tubes 64 and 67 as well as for the draw-in hoses 65, 66. The translatory movement of the jacket encasing tubes 64 and 67 on the jet tube 51 causes the compression of both draw-in hoses 65, 66 which at the same time also seal-off the interspace 72. Grout is fed under pressure through the valve coupler 55 into the injection packer 50; the grout reaches the interspace 72 through the passages 54 and 51*a* and the holes 69 and 68, and from there flows through the holes 11 in the spreader pipe 4 into the cracks and hollow spaces of the concrete wall 20 (not shown).

Within the framework of part of the invention, a known spreader pipe without holes is provided with a socket 41, and a sealing device such as, for instance, the injection canal 43 feeds sealing material as described through the spreader pipe to the joint area between two concrete bodies built successively. The described injection packer 50 is particularly suited for this purpose. However, the introduction of sealing materials into the spreader pipe without holes and with sockets 41 can also be carried out with conventional injection packers using a conventional method.

It also falls within the framework of the invention to use spreader pipes 4, 40 with a socket 41 in order to fill several adjacent spreader pipes 4, 40 simultaneously and in one operation using an injection packer inserted in one spreader pipe, whereby the sockets of adjacent spreader pipes 4, 40 are connected through hoses and/or tubes and the depression holes of the adjacent spreader pipe 4, 40 are plugged up. A sealing device 43 can also be inserted at the same time using the appropriate connection.

What is claimed is:

1. A spreader pipe for placing between and bracing boarding plates parallel to each other at a distance equal to a thickness of a concrete wall to be erected by pouring liquid concrete into an interspace between the boarding plates, comprising:

the spreader pipe being sufficiently stiff to brace the boarding plates separated from each other when force is applied urging the boarding plates toward each other;

the spreader pipe having a wall comprising (1) at least one hole communicating with an interior of the spreader pipe and a continuous, impermeable cuff covering the at least one hole in the spreader pipe such that liquid concrete being poured into the interspace between the boarding plates cannot pass through the at least one hole into the spreader pipe wherein the cuff permits grout to flow through the at least one hole in the wall of the spreader pipe as the grout is forced into the interior of the spreader pipe after the liquid concrete has set and the boarding plates are removed from the concrete wall being erected, so that the grout flows from the spreader pipe to enter hollow spaces or cracks in areas of the concrete wall adjacent to the spreader pipe; or (2) at least one weak point wherein the spreader pipe is impervious to the liquid concrete to be poured into an interspace between the boarding plates and wherein the weak points are such that they burst under pressure from the grout being forced into the spreader pipe, thereby allowing the grout to flow into hollow spaces or cracks in the concrete wall being exerted, outside the wall of the spreader pipe;

thereby making the concrete wall substantially waterproof in the areas adjacent to the spreader pipe.

2. A spreader pipe according to claim 1 wherein the spreader pipe comprises a wall with at least one weak point wherein the spreader pipe is impervious to the liquid concrete to be poured into an interspace between the boarding plates;

the weak points being such that they burst under pressure from the grout being forced into the spreader pipe, thereby allowing the grout to flow into hollow spaces or cracks in the concrete wall being erected, outside the wall of the spreader pipe;

thereby making the concrete wall substantially waterproof in the areas adjacent to the spreader pipe.

3. A spreader pipe according to claim 1 wherein the spreader pipe comprises a wall with at least one hole communicating with an interior of the spreader pipe;

a continuous, impermeable cuff covering the at least one hole in the spreader pipe such that liquid concrete being poured into the interspace between the boarding plates cannot pass through the at least one hole into the spreader pipe; and the cuff permitting grout to flow through the at least one hole in the wall of the spreader pipe as the grout is forced into the interior of the spreader pipe after the liquid concrete has set and the boarding plates are removed from the concrete wall being erected, so that the grout flows from the spreader pipe to enter hollow spaces or cracks in areas of the concrete wall adjacent to the spreader pipe;

thereby making the concrete wall substantially waterproof in the areas adjacent to the spreader pipe.

4. Spreader pipe according to claim 3, wherein the spreader pipe has several holes (11) which are covered in order to prevent the penetration of liquid concrete.

5. Spreader pipe according to claim 4, wherein the cuff (12) covers the holes.

6. Spreader pipe according to claim 5, wherein the cuff (12) is mounted on an outside surface of the spreader pipe.

7. Spreader pipe according to claim 5, wherein the cuff (12) is made of wood pulp.

8. Spreader pipe according to claim 7, wherein the wood pulp has a moisture resistant impregnation or an impervious coating.

9. Spreader pipe according to claim 5, wherein the cuff (12) is made of flexible material.

10. Spreader pipe according to claim 9, wherein the cuff (12) is a vent cuff having short slits (12*a*) through the cuff.

11. Spreader pipe according to claim 10, wherein the slits (12*a*) are not located over a hole (11) in the spreader pipe.

12. Spreader pipe according to claim 11, wherein several slits (12*a*) are made along an axis-parallel line forming a row on the cuff.

13. Spreader pipe according to claim 12, wherein a row of the slits (12*a*) are arranged on an axis parallel line of the spreader pipe staggered in relation to a row of the holes (11) on an axis-parallel line of the spreader pipe.

14. Spreader pipe according to claim 4, wherein a covering for the holes (11) comprises a cover made of a removable material.

15. Spreader pipe according to claim 14, wherein the removable material is placed on an inner surface of the wall of the spreader pipe.

16. Spreader pipe according to claim 14, wherein the removable material is wax.

17. Spreader pipe according to claim 14, wherein the covering comprises a cover of homogeneous material for the holes (11) in the form of weak points in the material.

18. Spreader pipe according to claim 4, further comprising a cover in the form of a pusher.

19. Spreader pipe according to claim 18, wherein the pusher is formed as a pipe section whose external diameter corresponds to an inside diameter of the spreader pipe and which is located in the spreader pipe.

20. Spreader pipe according to claim 3 to be used wherein the concrete wall is erected on a concrete base, further comprising:

a laterally projecting pipe socket (41) connected to an inside of the spreader pipe (40) and mounted on the spreader pipe, the pipe socket being in operative connection with at least another spreadermpipe or with an injection canal of a sealing device located in a joint area between the concrete wall and the concrete base on which the concrete wall is erected.

21. A method for erecting a concrete wall using boarding plates separated by at least one spreader pipe, comprising the steps of:

providing a spreader pipe of stiffness sufficient to brace the boarding plates apart from each other in response to an applied force urging the boarding plates toward each other and having a wall comprising (1) at least one hole communicating with an interior of the spreader pipe and a continuous, impermeable cuff covering the at least one hole in the spreader pipe such that liquid concrete being poured into the interspace between the boarding plates cannot pass through the at least one hole into the spreader pipe wherein the cuff permits grout to flow through the at least one hole in the wall of the spreader pipe as the grout is forced into the interior of the spreader pipe after the liquid concrete has set and the boarding plates are removed from the concrete wall being erected, so that the grout flows from the spreader pipe to enter hollow spaces or cracks in areas of the concrete wall adjacent to the spreader pipe; or (2) at least one weak point wherein the spreader pipe is impervious to the liquid concrete to be poured into an interspace between the boarding plates and wherein the weak points are such that they burst under pressure from the grout being forced into the spreader pipe, thereby allowing the grout to flow into hollow spaces or cracks in the concrete wall being exerted, outside the wall of the spreader pipe;

placing at least one spreader pipe between the boarding plates and applying a force between the boarding plates so that the spreader pipe braces the boarding plates separated from each other at a distance equal to a thickness of the concrete wall being erected;

pouring liquid concrete into the interspace and allowing the concrete to set to form a concrete wall, and removing the boarding plates from the concrete wall; and then forcing grout into the spreader pipe so as to either (1) press the grout through the holes in the wall of the spreader pipe and into hollow spaces or cracks in the concrete wall outside the wall of the spreader pipe, or (2) burst the weak points, thereby forming holes through the wall of the spreader pipe through which the grout flows into hollow spaces or cracks in the concrete wall outside the wall of the spreader pipe;

thereby making the concrete wall substantially waterproof in areas adjacent to the spreader pipe.

22. A method for erecting a concrete wall according to claim 21 which comprises the steps of:

providing a spreader pipe of sufficient stiffness to brace the boarding plates apart from each other in response to an applied force urging the boarding plates together;

the spreader pipe having a wall with at least one weak point wherein the spreader pipe is impervious to the liquid concrete to be poured into an interspace between the boarding plates;

placing at least one spreader pipe between the boarding plates and applying a force between the boarding plates so that the spreader pipe braces the boarding plates separated from each other at a distance equal to a thickness of the concrete wall being erected;

pouring liquid concrete into the interspace and allowing the concrete to set to form a concrete wall, followed by removing the boarding plates from the concrete wall; and forcing grout into the spreader pipe so as to burst the weak points, thereby forming holes through the wall of the spreader pipe through which the grout flows into hollow spaces or cracks in the concrete wall outside the wall of the spreader pipe, so as to make the concrete wall substantially waterproof in areas adjacent to the spreader pipe.

23. A method for erecting a concrete wall according to claim 21 which comprises the steps of:

providing a spreader pipe of stiffness sufficient to brace the boarding plates apart from each other in response to an applied force urging the boarding plates toward each other and having a wall with at least one hole communicating with an interior of the spreader pipe, and having a continuous, impermeable cuff covering the at least one hole in the spreader pipe such that liquid concrete being poured into the interspace between the boarding plates cannot pass through the at least one hole into the spreader pipe;

placing at least one said spreader pipe between a pair of the boarding plates and applying a force between the boarding plates so that the spreader pipe braces the boarding plates separated from each other at a distance equal to a thickness of the concrete wall being erected;

pouring liquid concrete into the interspace and allowing the concrete to set to form a concrete wall, followed by releasing the force and removing the boarding plates from the concrete wall; and the forcing grout into the spreader pipe so as to press the grout through the at least one hole in the wall of the spreader pipe and into hollow spaces or cracks in the concrete wall outside the wall of the spreader pipe, thereby making the concrete wall substantially waterproof in areas adjacent to the spreader pipe.

24. Method according to claim 23 comprising the step of mounting the cuff around an outside of the spreader pipe.

25. Method according to claim 23, comprising using a cuff made of paper or cardboard.

26. Method according to claim 25, comprising using paper or cardboard material with a moisture resistant impregnation or an impervious coating of the cuff.

27. Method according to claim 23, comprising using a cuff made of flexible material.

28. Method according to claim 27, comprising using a cuff made of plastic.

29. Method according to claim 23, comprising forming vent slits in the cuff.

30. Method according to claim 23, comprising using a pusher operated from outside the spreader pipe to close the at least one hole.

31. Method according to claim 30, comprising using the pusher shaped as a pipe section having an outside diameter equivalent to an inside diameter of the spreader pipe in the proximity of the at least one hole, the pusher being in the spreader pipe.

32. Method according to claim 23, comprising plugging the at least one hole in the spreader pipe with removable material.

33. Method according to claim 32, comprising placing the removable material on inner walls of the spreader pipe.

34. Method according to claim 32, comprising using ductile mass as the removable material.

35. Method according to claim 32, comprising using wax as the removable material.

36. Method for erecting a concrete wall according to claim 23, whereby the concrete wall is erected on a concrete base, and a sealing device with an injection canal open on a side of the concrete base is placed in a joint area of the concrete wall being erected adjacent to the concrete base, and further comprising the step of forcing grout through an opening in the spreader pipe and through a pipeline connected to the injection canal so as to press the grout into hollow spaces or cracks between the concrete wall and the concrete base.

37. A method for erecting a concrete wall on a joint area of a concrete base, comprising the steps of:

placing a sealing device with an injection canal at the joint area of the concrete base;

placing boarding plates on the concrete base parallel to each other and separated from each other at a distance equal to a thickness of the concrete wall being erected;

placing between the boarding plates, a stiff spreader pipe having a wall with at least one hole communicating with an interior of the spreader pipe and having a continous, impermeable cuff covering the at least one hole in the spreader pipe such that liquid concrete being poured into the interspace between the boarding plates cannot pass through the at least one into the spreader pipe;

applying force tending to urge the boarding plates together, so that the stiff spreader pipe braces the boarding plates apart from each other at a distance equal to a thickness of the concrete wall being erected;

providing a pipeline connecting the spreader pipe with the injection canal of the sealing device;

pouring liquid concrete into the interspace and allowing the concrete to set to form a concrete wall, followed by the boarding plates from the concrete wall being erected; and then forcing grout into the spreader pipe so as to press the grout through the at least one in the wall of the spreader pipe and into hollow spaces or cracks in the concrete wall outside the wall of the spreader pipe, and through the pipeline into the injection canal of the sealing device, thereby making the concrete wall substantially waterproof adjacent to the spreader pipe and adjacent to the joint area of the concrete base.

* * * * *